United States Patent [19]

Ondracek

[11] 4,383,944

[45] May 17, 1983

[54] METHOD FOR PRODUCING MOLDED BODIES CONTAINING HIGHLY ACTIVE RADIOACTIVE WASTES FROM GLASS GRANULES EMBEDDED IN A METALLIC MATRIX

[75] Inventor: Gerhard Ondracek, Linkenheim, Fed. Rep. of Germany

[73] Assignee: Kernforschungszentrum Karlsruhe Gesellschaft mit beschränkter Haftung, Karlsruhe, Fed. Rep. of Germany

[21] Appl. No.: 108,166

[22] Filed: Dec. 28, 1979

[30] Foreign Application Priority Data

Dec. 28, 1978 [DE] Fed. Rep. of Germany ..... 2856466

[51] Int. Cl.[3] ..... G21F 9/16

[52] U.S. Cl. ..... 252/628; 252/629; 264/0.5

[58] Field of Search ..... 252/301.1 W, 628, 629; 264/0.5; 75/206

[56] References Cited

U.S. PATENT DOCUMENTS

| | | | |
|---|---|---|---|
| 3,878,275 | 4/1975 | Kasberg | 252/301.1 W |
| 4,072,501 | 2/1978 | Quinby | 252/301.1 W |
| 4,115,311 | 9/1978 | Sump | 252/301.1 W |
| 4,280,921 | 7/1981 | May | 252/301.1 W |

FOREIGN PATENT DOCUMENTS

| | | | |
|---|---|---|---|
| 2524169 | 12/1976 | Fed. Rep. of Germany . | |
| 2551349 | 5/1977 | Fed. Rep. of Germany | 252/301.1 W |

OTHER PUBLICATIONS

Rusin et al., "Development of Multibarrier Nuclear Waste Forms", In: McCarthy, ed., *Scientific Basis for Nuclear Waste Mgmt.*, vol. 1, (New York, Plenum Press, 1979), pp. 169–180, 1978.

Goetzel, C. G., *Treatise on Powder Metallurgy*, vol. I, Interscience Publishers, Inc., New York, (1949), pp. 137–139 and 241–257.

*Primary Examiner*—Deborah L. Kyle

*Attorney, Agent, or Firm*—Spencer & Kaye

[57] ABSTRACT

A method for producing a molded body containing highly radioactive wastes. The wastes are mixed with molten glass or are melted together with glass formers, and converted into glass granules or glass powder. These granules or powder are mixed with a metal powder containing at least one of the metals lead, iron, silver, cobalt, nickel and tin, and the mixture is condensed at pressures of 25 to 500 Newtons/mm$^2$ to form a molded body.

14 Claims, No Drawings

METHOD FOR PRODUCING MOLDED BODIES CONTAINING HIGHLY ACTIVE RADIOACTIVE WASTES FROM GLASS GRANULES EMBEDDED IN A METALLIC MATRIX

BACKGROUND OF THE INVENTION

The present invention relates to a method for producing molded bodies containing highly radioactive wastes wherein the wastes are mixed with molten glass or are melted together with glass formers, the resulting melt is converted to glass granules or glass powder and these granules or the powder are embedded in a matrix of pure metal or metal alloys.

The necessity of providing long-term storage for solidified products containing highly radioactive wastes in, for example, salt stocks, brings about the following requirements for these final storage products:

First, the product must be at an internal thermochemical equilibrium, i.e. it must be in a minimum energy state since this is presently the best assurance for thermochemical stability.

Second, the product must be of such consistency that interactions with the environment cannot become a safety risk. Such interactions cannot be completely excluded since, due to the actual conditions of state and the possible changes in these conditions of state over a long period of time, it cannot be assured that an equilibrium remains in effect at the storage location between the final storage product and its environment.

If these requirements are not met, changes in the product may adversely affect the interactions between various components or phase conversions or its properties, such as, for example, heat conductivity, corrosion resistance or strength, and chemical and/or mechanical interactions with the environment, such as leaching or mechanical stresses as a result of geologic pressure and shear forces, may destroy the final storage products wholly or in part. Such a destruction would involve the uncontrollable transfer of highly radioactive fission products into the biosphere.

In order to solidify radioactive wastes for storage, it is well known to treat waste containing aqueous solutions by first reducing the volume of such wastes, thereby concentrating the radioactive substances, and then treating the concentrates by subjecting them together with glass formers to a heat treatment until the radioactive substances become distributed throughout the resulting glass melt, which is solidified into a solid body. Alternatively, the waste containing solution may be denitrated, spray dried, and calcined and the resulting calcinate may then be mixed in solid form with a glass former or with a ground, previously produced glass frit.

In the course of prolonged storage, decomposition of the glass structure produced by the prior art methods may occur due to the continued emission of radiation and heat energy by the incorporated highly radioactive substances. As a result, the resistance of the glass structure to leaking deteriorates with time, and its ability to effectively retain radioactive materials is diminished, as compared with the nondecomposed glass structures which are highly resistant to leaching.

In order to effectively increase the resistance to leaking of the well known waste and glass solidification products of the prior art, and to insure their physical stability for extended periods, German Offenlegungsschrift No. 2,524,169 discloses a process in which a glass melt containing the highly radioactive fission products is initially converted to glass granules and these granules are then filled into metal containers. Then, the empty space between the granules is filled with molten metal or a molten alloy, preferably of lead or lead alloys. This process is not supposed to result in an increase of the bulk volume of the waste granules within the containers.

The surrounding or encasing of the glass granules with metal melts has the grave drawback, however, that a product is obtained in which the glass granules contact one another. Thus, it cannot be excluded that in the process according to German Offenlegungsschfrift No. 2,524,169:

(a) the points of contact of the glass granules with one another react to mechanical stresses which causes constant brittle fracture; and (b) with respect to corrosion or leaching, there always exists access from the environment to all fission product-containing granules in the interior of the product.

Moreover, in the process according to German Offenlegungsschrift No. 2,524,169, the selection of usable metal melts is limited to those whose wetting with the types of glass employed is satisfactory and whose coefficients of thermal expansion are sufficiently low compared to that of glass that contact at the metal-glass interface remains in existence at all times, even after cooling of the mixture from temperatures above the melting point of the metal.

Contact between glass and metal must be maintained at least to an extent which assures the heat transfer to the metal phase during final storage.

SUMMARY OF THE INVENTION

It is an object of the present invention to provide a process for producing a solidification product of glass granules containing highly radioactive wastes which are embedded in a metal matrix, the solidification product being storable for extended or unlimited periods.

It is another object of the present invention to embed the glass granules discontinuously in a continuous metallic matrix to prevent the glass granules from contacting one another.

It is a further object of the present invention to produce a solidification product in which heat transfer from the glass phase to the metal phase during storage is assured.

In order to achieve these objects, and in accordance with its purpose, the present invention provides a method for producing molded bodies containing highly radioactive wastes, in which the wastes are mixed with molten glass or are melted together with glass formers to form a melt, and the melt is converted into glass granules or glass powder comprising:

(a) mixing the glass granules or glass powder with a powder of a metal selected from the group consisting of lead, iron, silver, cobalt, nickel, tin, and mixtures thereof, wherein the glass to metal ratio is selected so that the glass to metal ratio in the molded body is 20:1 to 1:6; and (b) condensing the mixture resulting from step (a) by subjecting the mixture to pressure of 25 Newtons/mm$^2$ to 500 Newtons/mm$^2$ to form a molded body.

Preferably, the condensed mixture is sintered at a temperature below the melting point of the lowest melting metal present in the mixture, in order to increase the strength and density of the molded body.

It is to be understood that both the foregoing general description, and the following detailed description are exemplary, but are not restrictive of the invention.

DETAILED DESCRIPTION OF THE INVENTION

The waste materials treated according to the present invention are the by-products of manufacturing, processing and reprocessing of nuclear fuels as well as the wastes of nuclear plants and the like. Typically, they are in water solution or suspension. The wastes treated according to the present invention generally are high activity waste solutions which comprise nitric acid solutions containing predominantly heavy metal nitrates, which are produced during the separation of fission products from spent nuclear fuels.

The invention is also applicable to other wastes such as medium activity waste solutions, which are predominantly nitric acid solutions, generally containing a large amount of sodium nitrate, which are obtained during reprocessing of nuclear fuels and during decontamination processes in nuclear plants.

The invention is also applicable to actinide concentrates, which are solutions or powders or combustion residues, which are obtained mainly as waste products during the processing and manufacture of nuclear fuels.

The invention is further applicable to ashes and residues from the combustion of organic radioactive wastes which ashes and residues are fine-grained solid wastes and are suspended in water. A typical aqueous radioactive waste solution which can be treated is a highly radioactive aqueous waste solution (HAW) which is obtained during reprocessing of irradiated nuclear fuel and/or breeder materials after the common extraction of uranium and plutonium in the first extraction cycle of an extraction cycle. These solutions generally contain nitric acid and generally are denitrated before being spray dried and calcinated.

In the process of the present invention, the radioactive waste is combined with glass so that the waste is distributed throughout the glass. This combination may be made by the techniques of the prior art in which the wastes are mixed with molten glass, or melted together with glass or glass formers.

In one such method, a waste solution is evaporated to concentrate the radioactive substances. The concentrated wastes are then subjected with glass formers, such as $SiO_2$, $K_2O$, and the like to heat treatments until the waste is distributed throughout the resulting glass melt, which is then solidified.

In another process, the waste solution is denitrated, then spray dried and calcined to form a powder. The powder is mixed with glass formers or a previously produced ground, glass frit of known composition, and this mixture is melted in a crucible or furnace to form a homogeneous mass.

The glass former or glass frit may also be added to the waste solution prior to spray drying and calcination. When this is done, a particularly pure and finely dispersed silicic acid known as Aerosil can be added to the waste solution in order to obtain a uniform mixture of the components being spray dried. This method is reported by J. Saidl in an article entitled "Verfestigung hochaktiver Spaltprodukte in Glas" (Solidification of Highly Active Fission Products in Glass), in the Annual Report for 1973-Department of Decontamination Operations; Report of the Gesellschaft für Kernforschung mbH, No. KFK-2126, May 1975.

The solidified glass containing the waste product is then converted to a glass powder or glass granules which may vary in size depending on the application. The glass powder or glass granules are obtained by mechanical crushing and milling the bulk glass compacts, where the general size distributions vary between $\leqq 1$ μm up to $\geqq 1$–2 mm.

These glass granules or glass powder are mixed with a powder of a metal selected from the group consisting of lead, iron, silver, cobalt, nickel, tin and mixtures thereof. The volume ratio of glass to metal should be selected so that the volume ratio in the molded body will be 20:1 to 1:6.

The mixing of the glass granules or glass powder with the metal powder preferably is done mechanically, in a mixing media, or by coating the glass granules or glass powder with the metal powder, or by a combination of mechanical mixing in a mixing media and coating. Whatever method is used, thorough mixing should be assured.

The mixture of metal particles and glass granules or glass powder is then condensed by pressing at pressures between 25 Newtons/mm$^2$ and 500 Newtons/mm$^2$ to form a molded body. This is generally done at ambient temperatures; room temperature (20° C.–25° C.) is preferred.

In the case of lead, for example, pressing results in the formation of a solid, glass-metal molded body. In order to increase the strength and density of the molded bodies of the invention, sintering may take place after pressing, at a temperature below the melting point of the metal phase, or its lowest melting member, which results in little or no evaporation, particularly of radioactive waste fission products. Sintering should be used with iron, silver, cobalt, and nickel, and is optional with lead and tin.

By proper selection of the glass-to-metal ratio, the size of the individual granules or of the powder particles and the mixing conditions, a product is obtained in which the glass granules or the glass powder containing the radioactive waste fission products are discontinuously embedded in a continuous metal matrix phase. The average interparticle space (λ) for the glass granules is given by $$\lambda = L_3 \frac{V_M}{1 - V_M}$$

where $L_3$ is the average size (intercept length) of glass granules and $V_M$ is the volume content of the metal phase. The equation provides the interrelationship between λ, $L_3$ and $V_M$ to keep a proper distance ($\lambda \geqq L_3$) between the discontinuously embedded glass granules. The time of mixing depends on the sort of powders. Generally good distributions of the glass granules in the metal matrices which is to say discontinuity of the glass particles—are obtained the more the condition is approached that $$\frac{L_3 \text{ glass}}{L_3 \text{ metal}} \approx \sqrt[3]{\frac{\rho \text{ glass}}{\rho \text{ metal}}}$$

where ρ means density. If there should exist access to a granule or a powder particle from outside the molded body by corrosion or leaching media, only this one granule or particle is in contact with the environment, while all others remain insulated. Substantial corrosion and leaching is thereby prevented.

The metal matrix gives ductility to the molded body by allowing plastic deformation when the molded body is under mechanical stress, thereby avoiding destruction of the granules or of the particles. The glass granules or particles "float" in the metal matrix phase without contacting each other, and the product is no longer subject to brittle fracture.

The drawbacks of the prior art processes are thus overcome by the use of powder technology in the present process for producing glass-metal products. Due to the low manufacturing temperatures of the molded body, which do not bring about a liquid phase, wetting between glass and metal, and difference in thermal expansion play no significant part in the contact at the glass-metal interface, so these factors will not influence the type of metal phase employed. The heat transfer from glass-to-metal is always assured. At the temperatures used, little or no evaporation, especially of radioactive waste fission products, occurs. Moreover, characteristics such as the heat conductivity can be varied with a given glass granule or glass powder concentration, by suitable selection of the shape and orientation of the granule or of the powder particles, and thus, optimized. The glass powder or granules can either approach spherical form or spheroidal shapes as platelets or cylindrical fibers. Highest thermal conductions in isotropic materials for example are achieved with spheres and fibers statistically oriented.

The following example is given by way of illustration to further explain the principles of the invention. This example is merely illustrative and is not to be understood as limiting the scope and underlying principles of the invention in any way. All percentages referred to herein are by weight unless otherwise indicated.

EXAMPLE

Glass balls less than 2 mm in diameter were mixed with lead powder which was sedimentatively matched by way of a determination of its powder characteristic (e.g. particle size and shape, chemical composition, microstructure and particle density), i.e. the mixing was done in a liquid whose viscosity was variable as for example glycerin and alcohol in variable concentrations. The suspension of glass and lead in liquid was disposed in a mixing vessel which was moved in a tumbling mixer for about 3 hours, until a macroscopically homogeneous distribution of the two powders in the suspension had been achieved. Due to the sedimentatively matched similar sinking speeds, this distribution remained the same even after the powders settled in the suspension.

The liquid was next evaporated at sufficiently low temperatures to avoid oxidation of the lead, which was minimized. The mixture was then pressed in steel molds at about 100 Newtons/mm$^2$ compression pressure avoiding excessive pressure which would cause the resulting molded balls to burst. Finally, the pressed mixture was sintered at about 400° K. for about 5 hours.

In this example, the mixing ratio of volume of lead : volume of glass was equal to 7:1.

The strength of the resulting molded bodies was good, and their diameter was 2 cm.

It will be understood that the above description of the present invention is susceptible to various modifications, changes and adaptations, and the same are intended to be comprehended within the meaning and range of equivalents of the appended claims.

I claim:

1. A method for producing a molded body containing radioactive wastes, in which the wastes are mixed with molten glass or are melted together with glass formers to form a melt, and the melt is converted into glass granules or glass powder comprising:

(a) mixing the glass granules or glass powder with a powder of a metal selected from the group consisting of lead, iron, silver, cobalt, nickel, tin and mixtures thereof, wherein the glass-to-metal ratio is selected so that the glass-to-metal ratio in the molded body is 20:1 to 1:6, by volume, and, (b) condensing the mixture resulting from step (a) by subjecting the mixture to pressure of 25 Newtons/mm$^2$ to 500 Newtons/mm$^2$ to form a molded body in which the glass granules or glass powder are discontinuously embedded without contacting each other in the metal which forms a continuous metal matrix phase.

2. The method of claim 1, further comprising sintering the condensed mixture at a temperatue below the melting point of the lowest melting metal present in the mixture, in order to increase the strength and density of the molded body.

3. The method of claim 1 or 2 wherein the step of condensing the mixture is done at room temperature.

4. The method of claim 1 or 2, wherein the glass granules or glass powder and metal powder which are mixed are sedimentatively matched.

5. The method of claim 1 or 2 wherein said radioactive wastes are high activity radioactive wastes.

6. The method of claim 1 or 2 wherein said radioactive wastes are medium activity radioactive wastes.

7. The method of claim 1 or 2 wherein said radioactive wastes are derived from actinide concentrates or from ashes and residues of combustion of organic radioactive wastes.

8. The method according to claim 1 or 2 wherein the particle size of said glass granules or glass powder is about 1 $\mu$m to about 2 mm.

9. The method of claim 1 or 2 wherein said glass granules or glass powder have particles in the form of spheres or cylindrical fibers, said particles being statistically oriented in the molded body.

10. The method of claim 1 or 2 wherein the ratio of the average size of the particles of said glass granules or glass powder to the average size of the particles of said metal powder is approximately equal to $$\sqrt[3]{\frac{\rho \text{ glass}}{\rho \text{ metal}}}$$

where $\rho$ glass is the density of the glass and $\rho$ metal is the density of the metal.

11. The method of claim 1, wherein the metal powder is lead.

12. The method of claim 1, wherein the metal powder is silver.

13. The method of claim 1, wherein the metal powder is a mixture of metal powders.

14. The method of claim 1, wherein the metal powder is selected from the group consisting of lead, silver, cobalt, tin and mixtures thereof.

* * * * *